United States Patent [19]

Steinlein et al.

[11] 4,013,021

[45] Mar. 22, 1977

[54] PLASTICS MATERIAL PALLET

[76] Inventors: Rudolf Steinlein, Almbachstrasse 8, 8 Munich 25, Germany; Alexander Schoeller, deceased, late of Munich-Solln, Germany; by Christina Schoeller, administratrix, Chesa Balaster, 7524 Zuoz (Engadin), Switzerland

[22] Filed: Jan. 20, 1975

[21] Appl. No.: 542,238

[30] Foreign Application Priority Data

Jan. 24, 1974 Germany ..... 2403374

[52] U.S. Cl. ..... 108/51.1; 108/901

[51] Int. Cl.[2] ..... B65D 19/32

[58] Field of Search ..... 108/51–58; 248/346

[56] References Cited

UNITED STATES PATENTS

| | | | |
|---|---|---|---|
| 3,307,504 | 3/1967 | Cloyd et al. | 108/58 |
| 3,531,855 | 10/1970 | Spring, Jr. | 108/51 X |
| 3,592,145 | 7/1971 | Petry | 108/51 |
| 3,645,215 | 2/1972 | Kirkpatrick | 108/51 |
| 3,654,874 | 4/1972 | Skinner | 108/51 |
| 3,720,176 | 3/1973 | Munroe | 108/51 X |
| 3,814,778 | 6/1974 | Hosoda et al. | 108/51 X |
| 3,868,915 | 3/1975 | Hafner | 108/53 X |

*Primary Examiner*—Roy D. Frazier
*Assistant Examiner*—William E. Lyddane
*Attorney, Agent, or Firm*—Depaoli & O'Brien

[57] ABSTRACT

A pallet which is formed by edge welding at least one rigid deck insert and four frame bearers to form a rigid frame and smoothly connecting eight supporting legs having supporting webs therewithin. The deck insert is molded as a single piece having a grid pattern. Each frame bearer is made by edge welding an upper boom, a lower boom and an intermediate web formed in a grid pattern matching the grid pattern of the deck insert, each individually molded. The smoothly curved outer surfaces of the eight legs and their supporting webs continue into and mate with corresponding surfaces and webs in both the deck insert and the frame bearers.

9 Claims, 25 Drawing Figures

PLASTICS MATERIAL PALLET

BACKGROUND OF THE INVENTION

1. Field of the Invention

The invention relates to a plastics material pallet and more particularly, but not exclusively, a flat pallet for bottle cases.

2. Review of the Prior Art

In a known pallet of the type on which the invention is based (German Laid-Open Specification No. 2 130 934) the fact that it is made up of several parts allows it to be produced from a plurality of section members prefabricated in a mould from plastics material, these members being of relatively small size. At the same time relatively considerable loads can be accepted. This is partly because both the decks are themselves of double deck construction and thus contribute to providing a stiffening effect. It is also advantageous that the load-bearing parts are in each case of one-piece construction over the entire height of such parts.

SUMMARY OF THE INVENTION

The invention has as its object to provide a pallet of this kind which has particularly good bending strength under load.

High bending strength for plastics material pallets according to the invention is due substantially to the production of the frame from hollow section members. An important idea of the invention consists in that first of all the frame insert is constructed and then the various individual parts of the frame are attached externally to this insert. The frame can be formed for example of two angular section member bearers with internally open cross-sections which are attached in succession to the insert and connected securely thereto. But preferably the frame is assembled from section member bearers which are identical in pairs, and for example first of all a parallel pair can be attached to the insert and then the other pair are attached. For constructing a pallet capable of taking considerable loads, a particularly reliable measure has been found to be the welding of all the parts to one another, more particularly by mirror welding. But if necessary it is also possible to connect the parts by adhesive connections or by positive connections or even to combine these connection methods with one another, for example using a positive connection for adjustment and the adhesive type of connection as a connection capable of transmitting forces. In individual cases the force-transmitting connection may also include partly adhesive connection and partly positive connection means.

The plastics material pallet can have an unbroken frame surface. At the same time it is possible to avoid having open pockets for the fork lift truck arms in the region of the engagement apertures which can easily be destroyed by mechanical action of the fork lift truck arms; on the contrary it is possible to arrange that if in the particular engagement aperture for the fork lift truck arms the external contour of the upper deck extends in an inwardly bevelled manner from the upper boom to the lower boom, the bevelled contour is in fact formed by the connecting web.

The part of the upper deck formed of the insert comprises advantageously vertical webs arranged in honeycomb or cross grid fashion. But it is also possible to use another arrangement of the vertical webs, for example in the form of side-by-side circles, polygons, parallelograms or other patterns including patterns with more imaginative geometry; for these vertical webs it is advantageous to use stiffening section members which have an L-shaped or preferably ⊥ -shaped cross section. These section members combine the advantage of outstanding rigidity with the advantage of avoiding the formation of pockets or corners which would tend to collect dirt. This makes cleaning easier, and in addition they can be easily formed from the external side of the pallet.

In a further development, the invention comprises supporting legs constructed as closed section members in cross-section and comprising complementary parts at various components. The closed sections for the supporting legs will be in this case more particularly circular, elliptical or in general rounded cross-sections. But it is also possible in the appropriate circumstances to use closed cross-sections provided with corners.

The required complementary components can easily be made in one piece with the parts to which they are secured, since they have open cross-section themselves.

The invention proposes not only single-deck and double-deck pallets but also pallets with hollow section skids. In this case the hollow section member of at least the external skids is constructed in a complementary manner from parts which on the one hand are connected integrally with the section member bearers and on the other hand are connected integrally with the insert.

A further important feature of the invention is that a hollow skid or the section member bearers forming the frame not only each have a box-like section themselves but also are combined by means of the supporting legs to form a unitary box structure which substantially improves the rigidity over and above the sum of the individual rigidity factors of the box sections. This effect can also be improved by stiffening inserts which also have a box section structure themselves and are integrally associated with an upper deck and a lower deck or with a lower double-boom skid through the agency of the supporting legs.

BRIEF DESCRIPTION OF THE DRAWINGS

The invention is explained in detail hereinafter with diagrammatic drawings showing constructional examples. In the drawings.

DETAILED DESCRIPTION

Figure 1:
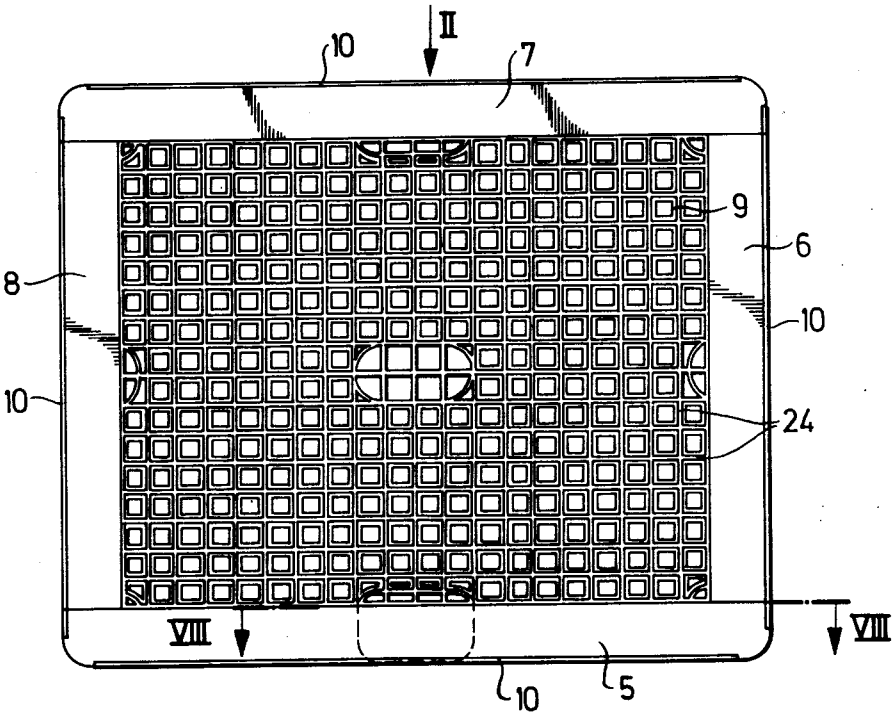
FIG. 1 shows a plan view onto a double-deck pallet with the features of the invention.
Figure 2:
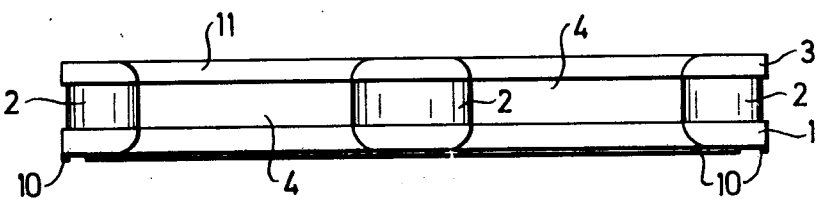
FIG. 2 shows a side view of the pallet of FIG. 1.
Figure 3:
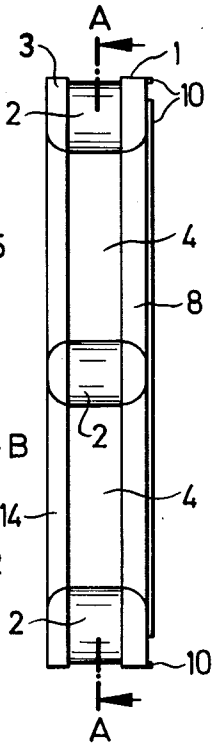
FIG. 3 shows a side view of the pallet of FIG. 1 moved through 90° as regards the direction of viewing as compared with FIG. 2.

The top deck 1 of a double-deck pallet according to FIGS. 1–3 bears by means of supporting legs 2 on a lower deck 3. Between the top deck 1 and lower deck 3 on the one hand and the supporting legs 2 on the other hand, fork lift truck engagement apertures 4 are provided at all four sides in the frame.

The top deck 1 comprises a frame composed of individual section member bearers 5, 6, 7 and 8, and also an insert 9 which is connected with the frame and fills the region enclosed by the frame. The section member bearers 5, 6, 7 and 8 are provided with a marginal ledge 10 which ends at some distance short of each of the corners of the upper deck 1.

Figure 4:
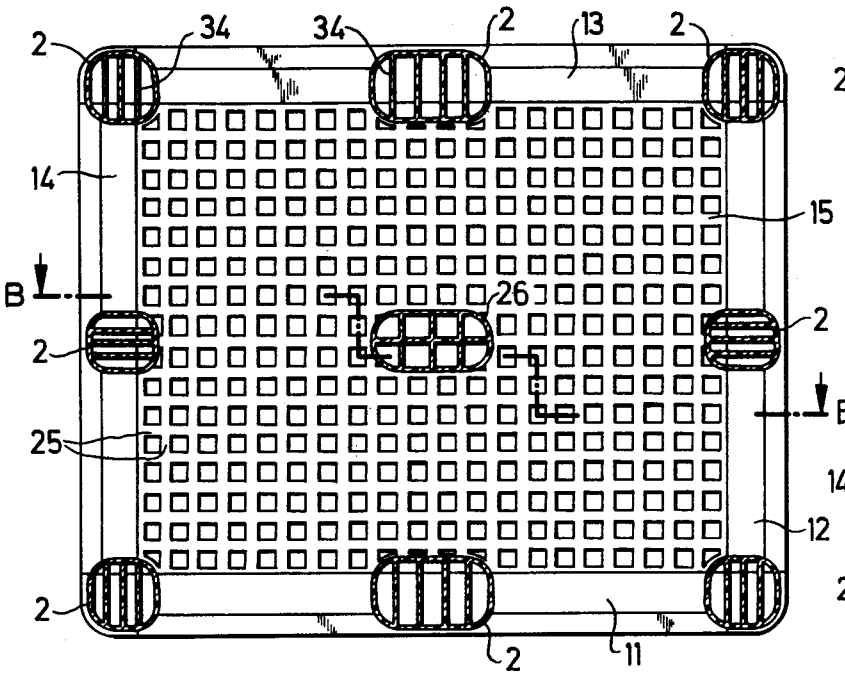
FIG. 4 shows the section A—A from FIG. 3.
Figure 5:
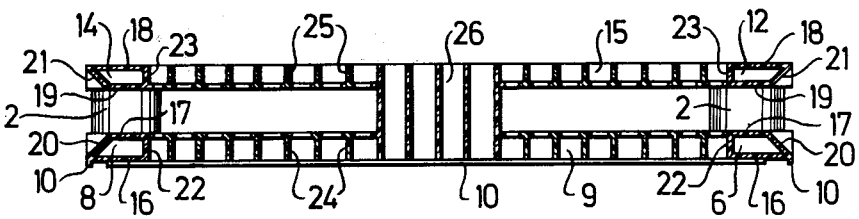
FIG. 5 shows the section through the pallet of FIG. 1 taken on the section line B—B in FIG. 4.
Figure 7:
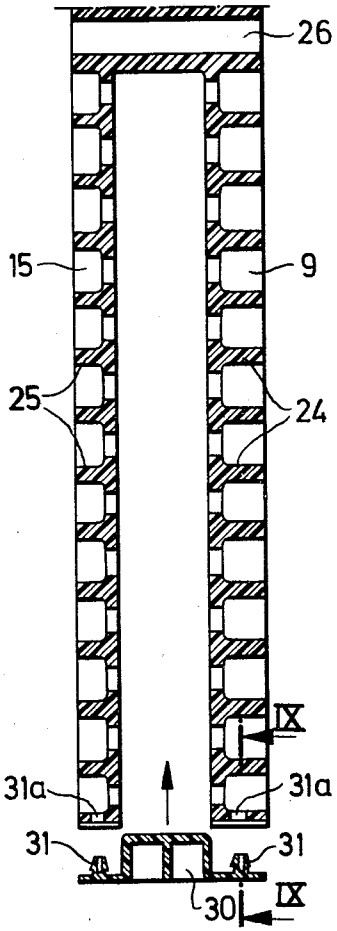
FIG. 7 shows the section C—C from FIG. 6
Figure 6:
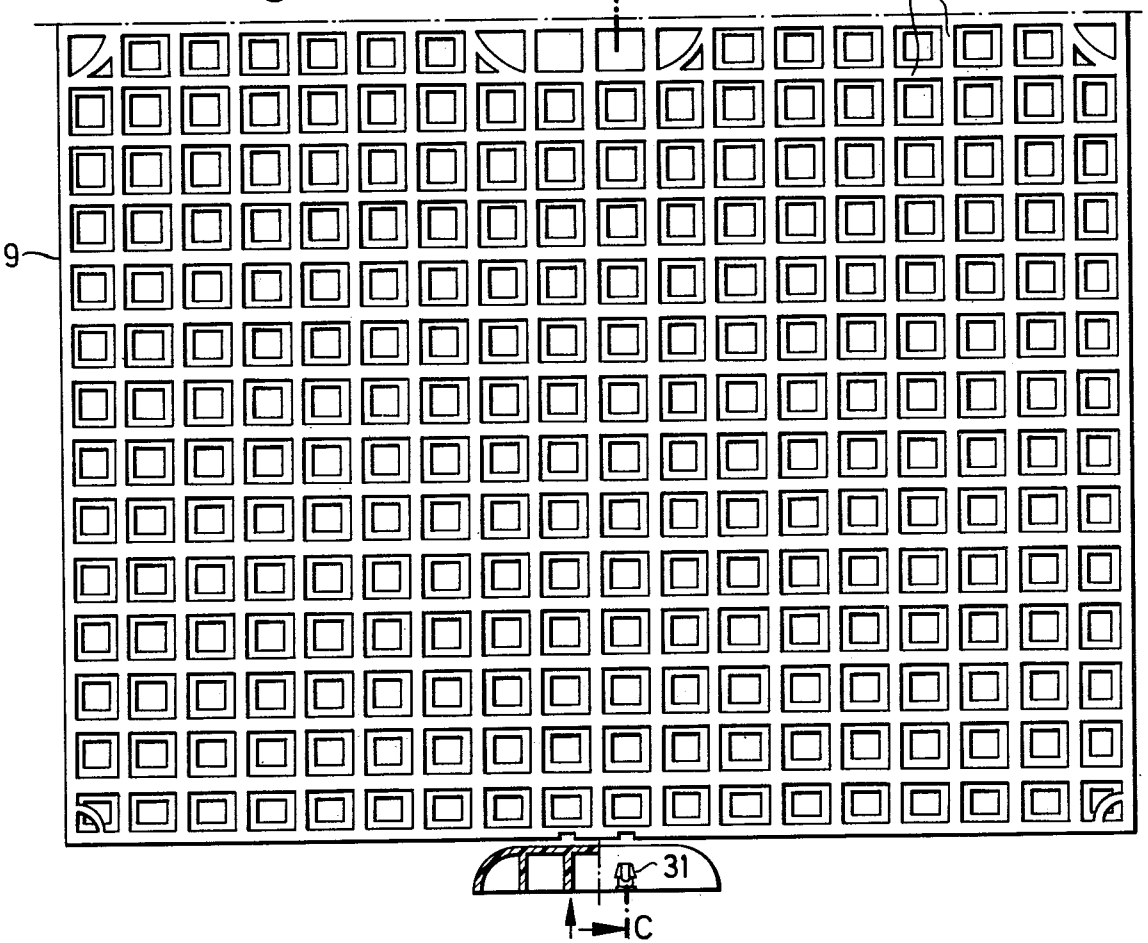
FIG. 6 shows a fragmentary plan view of the pallet insert of FIG. 1.

According to FIG. 4, the lower deck 3 is constructed to be substantially symmetrical in mirror-image relationship with the top deck 1. It simply does not have the encircling ledge 10.

The lower deck 3 also comprises a frame composed of individual section member bearers 11, 12, 13 and 14, in which frame there is arranged an insert 15 connected with the said frame and occupying the region enclosed by the frame.

The individual bearers forming the frame of the top deck 1 and lower deck 3 respectively are each constructed to be identical in pairs in each deck; thus the section member bearers 5 and 7 correspond to one another, likewise 6 and 8, 11 and 13, and 12 and 14. On the other hand the section member bearers 5, 11, and 6 and 12, 7 and 13, and also 8 and 14 arranged one above the other in the respective decks are also identical owing to the mirror image symmetrical relationship. This has the overall result that only two different section member types may be used.

The inserts 9 and 15 of the top deck 1 and lower deck 3 respectively also correspond to one another in the way they are arranged, with vertical webs 24 and 25 respectively arranged in cross grid fashion.

The part of the top deck 1 which is formed by the section member bearers 5, 6, 7 and 8 comprises an upper boom 16 and a lower boom 17 and the part of the lower deck of the pallet which is formed of the section member bearers 11, 12, 13 and 14 comprises a lower boom 18 and an upper boom 19. These booms are so connected to one another by an intermediate web 20 and 21 respectively that a cross-section is formed which is open towards the internal side of the frame. This open cross-section is supplemented at the top deck 1 and lower deck 3 at the internal side of the frame by the respective insert 9 or 15 by means of a closed edge 22, 23 respectively which extends round about the insert element.

The vertical webs of the inserts 9 and 15 respectively comprise a T-shaped (or an an alternative only L-shaped) cross-section. They are each so arranged that the transverse arm of the T (or L) faces towards the fork lift truck engagement apertures 4.

The connecting webs 20 and 21 extend at an inclination towards the inside of the pallet, thus forming entry ramps for the arms of the fork lift truck.

Figure 10:
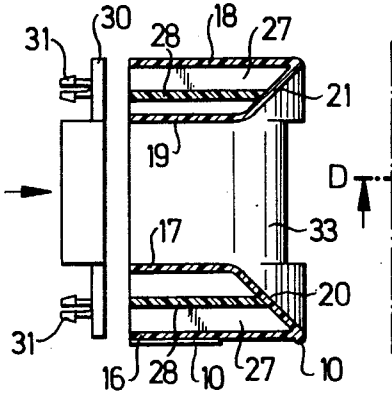
FIG. 10 shows the section E—E from FIG. 8.
Figure 14:
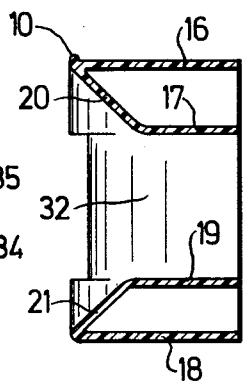
FIG. 14 shows a view on the section line G—G of FIG. 11.
Figure 13:
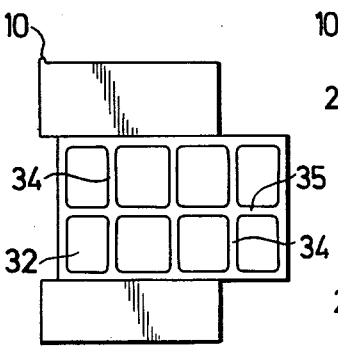
FIG. 13 shows the side view of the frame part of FIG. 11 in the viewing direction *v* in FIG. 11.
Figure 11:
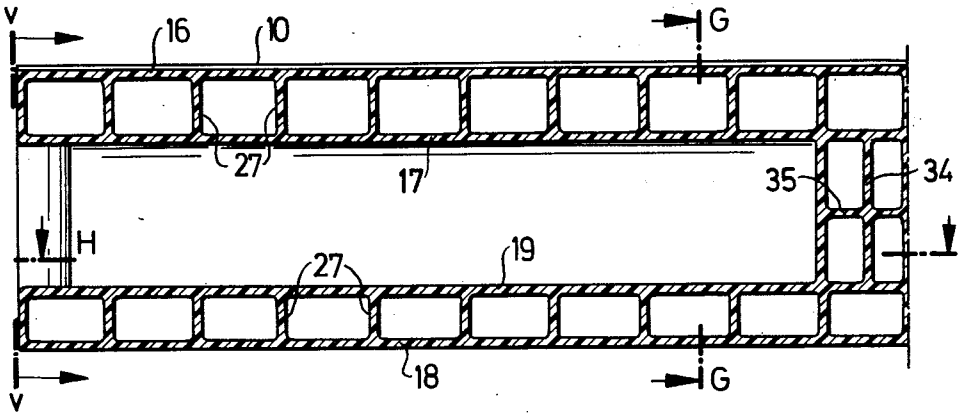
FIG. 11 shows a section through a portion of one of the shorter frame parts on the section line F—F from FIG. 9.

The internally open cross-section of the frame bearers 5, 6, 7 and 8 of the upper deck 1, and 11, 12, 13 and 14 of the lower deck 3 respectively comprises stiffening webs 27 which are arranged at right angles to the particular longitudinal direction of the frame. Additionally, there are provided reinforcing webs 28 which extend in the longitudinal direction of the frame and parallel to the booms 16, 17 and 18, 19 of the respective deck 1 or 3 as appropriate. In the constructional form shown in FIG. 11 these longitudinal stiffening webs have been omitted. As for example FIG. 10 shows clearly, both the transverse stiffening webs 27 and also the longitudinal stiffening webs 28 can easily be formed from the internal side of the frame when the frame section is produced. This makes it possible to bring about the injection moulding of the frame section together with the incorporated reinforcing sections.

The section member bearers 5 to 8 and 11 to 14 are made in one piece with parts of the supporting legs 2 situated between them.

The supporting legs 2 and 26 secured to the pallet all have rounded cross-sections which are closed and each consist of complementary individual parts secured to various components. Only the central supporting foot 26 between the two insert parts 9 and 15 is constructed as a one-piece section closed in itself. Its cross-section is all through the pattern of the upper insert part 9 and also the lower insert part 15, the pattern of the reinforcing webs 24 and 25 respectively of the inserts being continued in the interior of the cross-section of this supporting leg, (FIG. 1 and FIG. 4). The reinforcing ribs 24 and 25 respectively arranged in this central supporting foot 26 extend over the entire height of this supporting foot.

Figure 9:
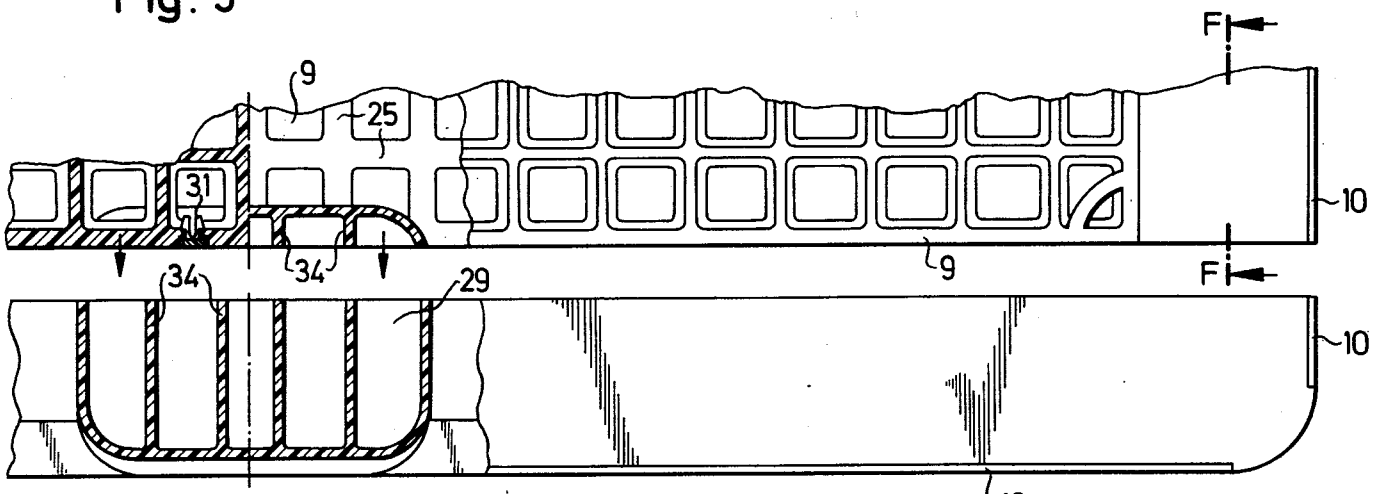
FIG. 9 shows a plan view of the frame part shown in FIG. 8 with a section on D—D showing details.
Figure 8:
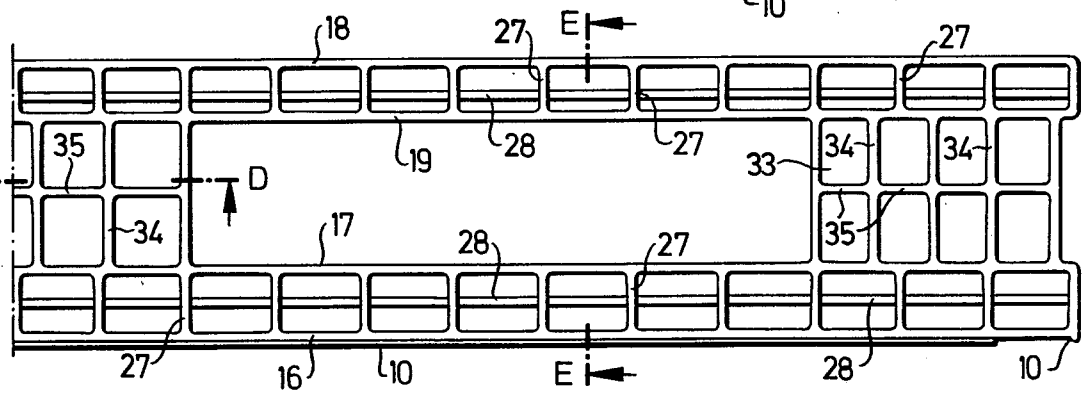
FIG. 8 shows a fragmentary side view of a frame part of the pallet from FIG. 1, seen from the pallet insert.

As FIG. 1 and FIG. 4 show clearly, there are also formed on the edge of the inserts 9 and 15 parts which complement the open cross-section of the supporting legs 2 provided on the section member bearers and together with the said open sections form in each case closed cross-sections for the supporting legs 2. In FIG. 9 this association of a section 29 secured to a long section member bearer and with a cross-section open towards the insert side and comprised by a central frame supporting leg with the corresponding complementary part formed on the insert 9 is illustrated. The insert is placed against the section member bearer in the direction indicated by the arrow and then connected therewith. Preferably the method of mirror welding is used wherein the welding arm is made to penetrate along the plane of division extending at right angles to the drawing plane in FIG. 9 between the insert and the section to be welded-on, and after it has been swung out the weld is produced by pressing the two parts together. However, other methods of joining the two parts are also suitable, and the use of adhesives, clips, welding or screwing may be mentioned more particularly. The complementary parts secured to the inserts 9 and 15 for the supporting legs 2 arranged on the frame are made in one piece together with the insert parts. If necessary, it is also possible subsequently to attach cladding pieces 30, for example by pressing onto split pins 31.

Figure 12:
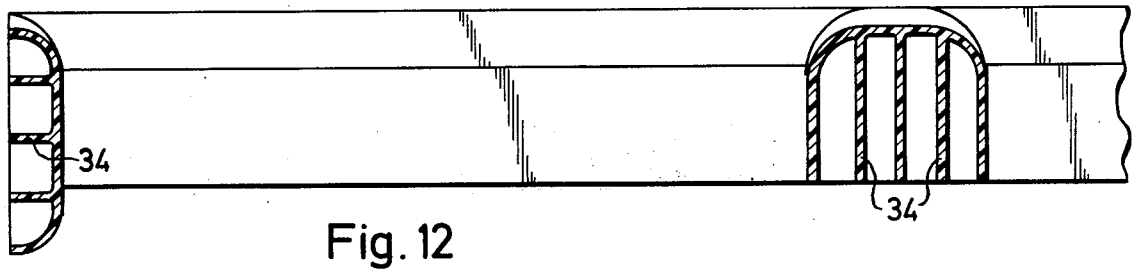
FIG. 12 shows a detail in a view on the section line H—H from FIG. 11.
Figure 15:
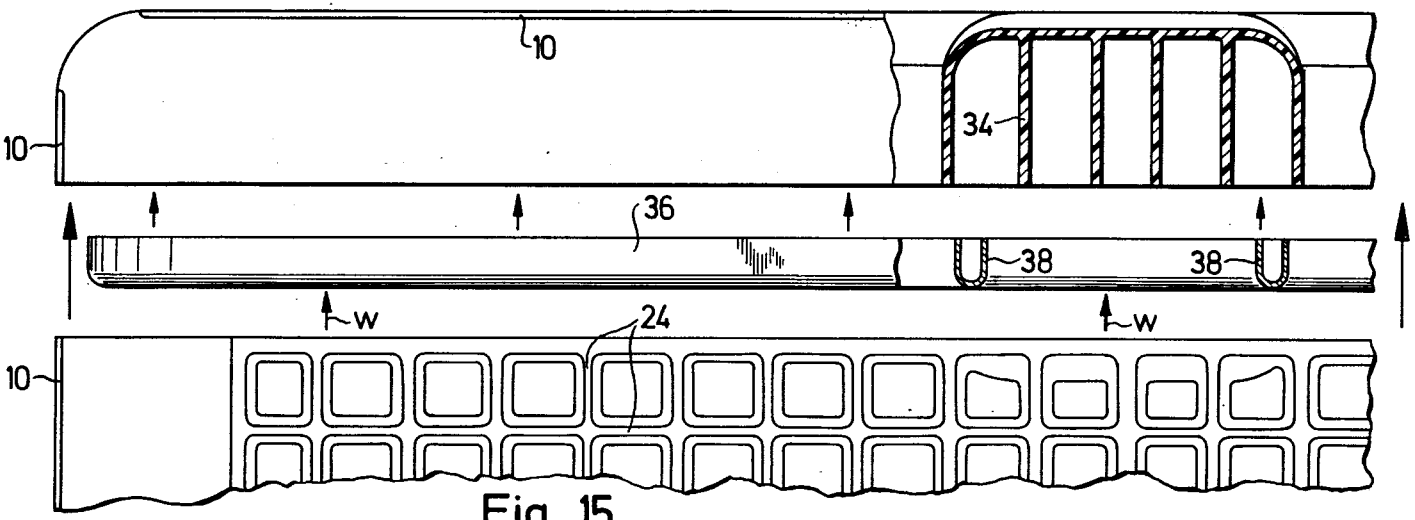
FIG. 15 shows a plan view of the same parts which are shown in FIG. 9 but showing a reinforcing section plate to be introduced into the frame bearer.
Figure 17:
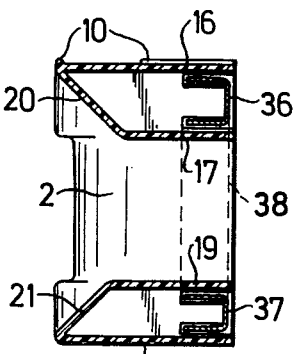
FIG. 17 shows a view on the section line K—K through the frame bearer of FIG. 16.
Figure 16:
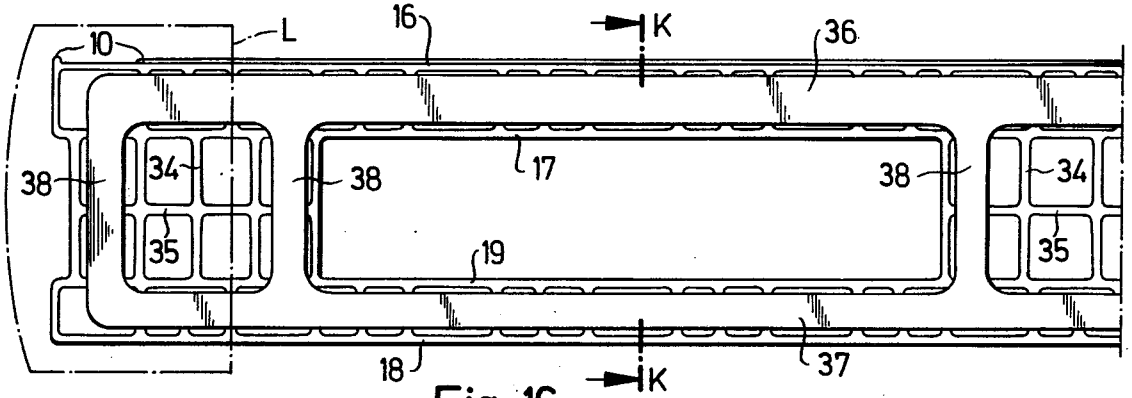
FIG. 16 shows a view in the direction w onto the external bearer of FIG. 15 with the reinforcing section plate inserted.
Figure 19:
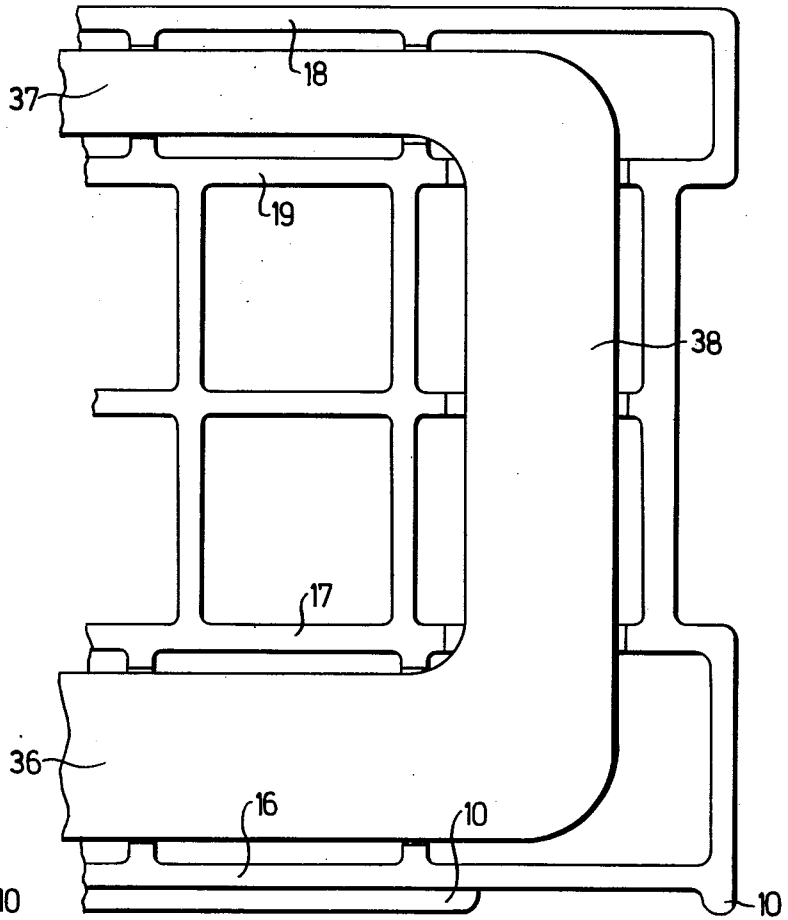
FIG. 19 shows a fragmentary view of the detail L from FIG. 16 on a larger scale.

In the pallet shown in FIG. 1 and FIG. 4 the supporting legs 2 arranged at the four corners of the pallet each consist of two complementary parts 32 and 33 associated with one another as shown in FIG. 8, 10, 12 and 13. Whereas the part 33 of the corner legs which is secured to the longer frame bearers is completely covered by the section member bearer in the plan view shown in FIG. 9, the part 32 which is complementary therewith and which is arranged on the corresponding end of the relatively short section member bearer projects at one side slightly beyond the width of this section member bearer (FIG. 12). As an alternative the part of the complementary supporting leg portion 32 projecting beyond the width of the bearer in FIG. 12 can be secured to the insert as a third complementary part.

Within the closed sections of the supporting legs 2 there are arranged vertical supporting ribs 34 and horizontal supporting ribs 35 as additional stiffening means for the supporting legs. These supporting ribs are formed simultaneously with the associated section member bearer or insert.

Figure 18:
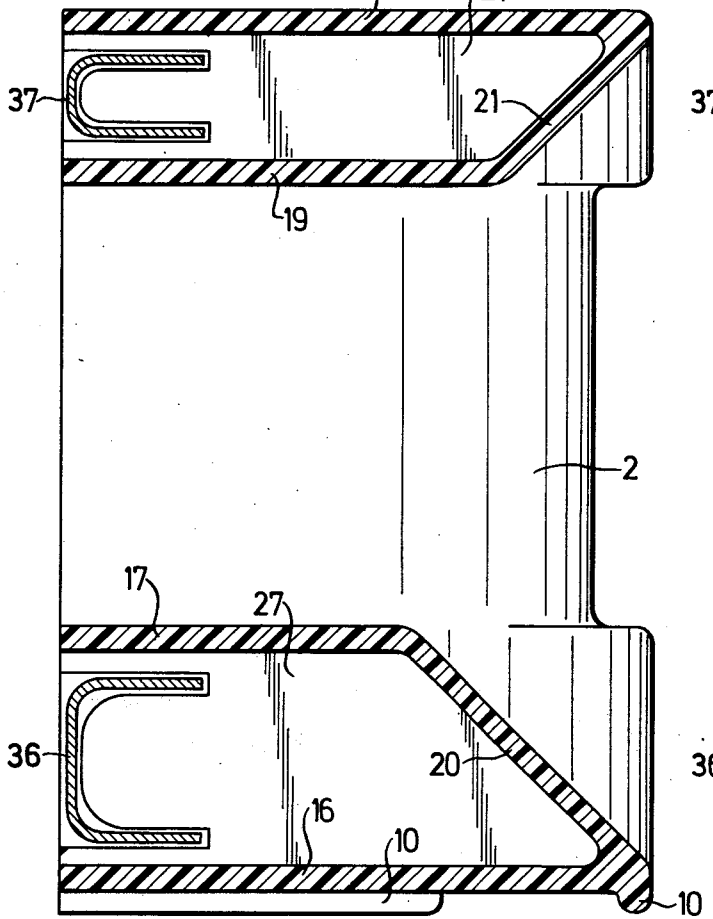
FIG. 18 shows a view on a larger scale of FIG. 17 (drawn turned through 180° relatively to FIG. 17)

To reinforce the section member bearers of the frame, as shown in FIGS. 15 to 19 additional reinforcing inserts 36 made of metal are inserted in the cross-section 16, 20, 17 and 18, 21, 19 open towards the internal side of the frame in the section member bearers of the two decks including the connecting supporting legs. These reinforcing inserts 36 are constructed as reinforcing sections which extend along the section member bearers of the upper deck 1 or lower deck 3 respectively and which have in FIGS. 15, 17 and 18 a U-shaped cross-section within each of the two decks 1 and 3 respectively, but may also abut for example in L-shaped manner on the webs. The reinforcing sections 36 are continued with formation of openings in the region of the fork lift truck engagement apertures 4 into the supporting legs 2, (FIG. 16 and FIG. 19), and the section insert 36 of the upper deck 1 extends by way of the connecting webs in the supporting legs 2 into the lower deck 3 and with a bent-over flange 37 bears either directly on the internal side of the lower boom 18 or with a small spacing therefrom in a suitable recess of the supporting ribs 27 (FIG. 18).

Instead of the metal reinforcing inserts 36, 37, 38, reinforcing insert elements made of different materials can also be used, for example fibre-reinforced materials. The entire reinforcing insert is pushed from the open side into the section member bearer where if necessary it can also be additionally secured. Then the insert is connected with the section member bearer.

The parts of the top deck 1 and lower deck 3 forming the insert and also the central supporting leg 26 which connects them directly, and the parts of the supporting legs 2 arranged thereon, are alternatively made in one piece or assembled from an upper part and a lower part in mirror image relationship.

The parts 5 and 11, 6 and 16, 7 and 13, and 8 and 14 which respectively form the frames and are situated one above the other, and the supporting legs 2 or parts or parts of supporting legs connecting such parts are in each case made in one piece. The supporting legs 2 are slightly set back from the outside edge of the top deck.

Figures 20, 21, 22, 23, 24:
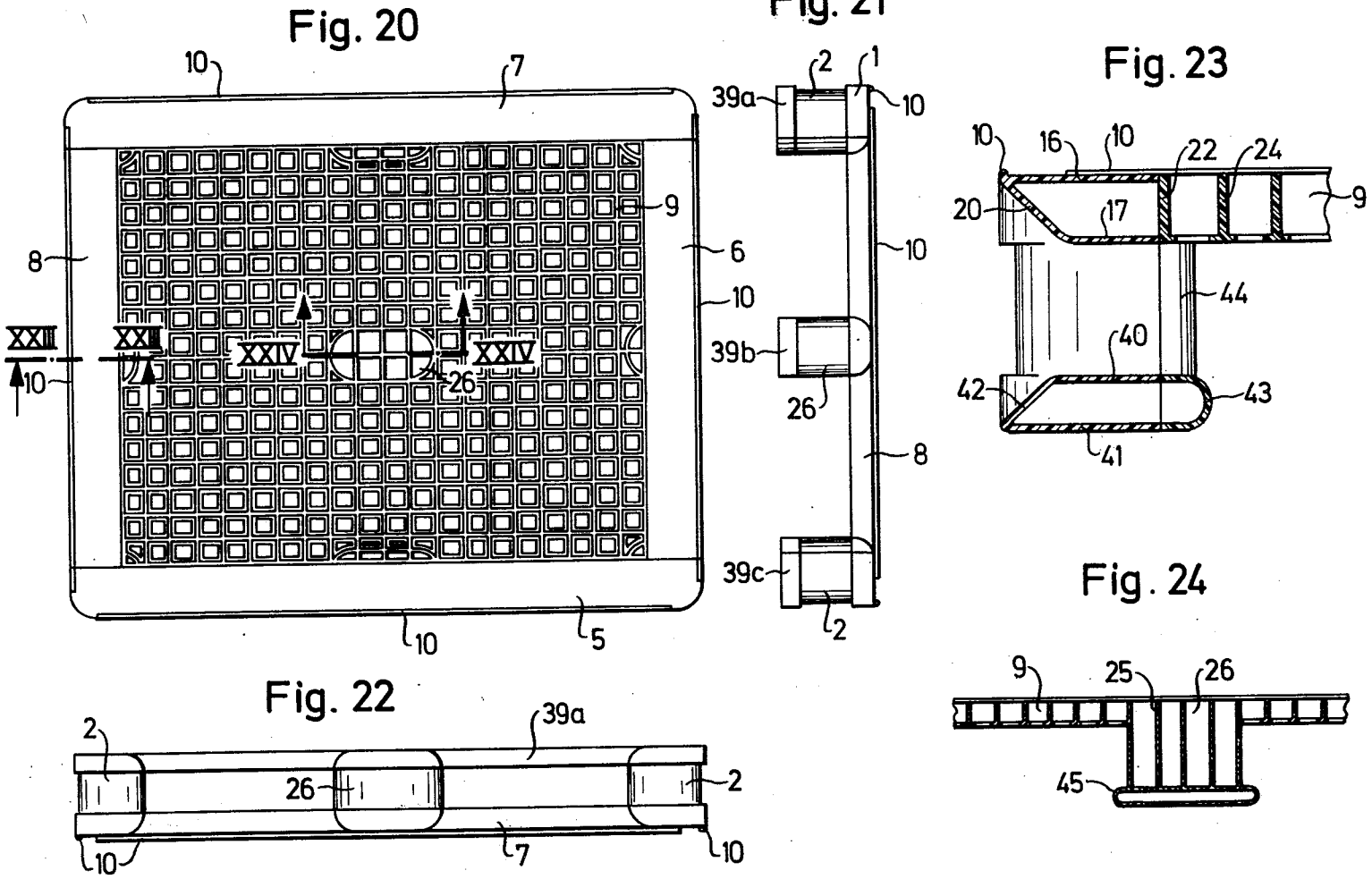
FIG. 20 shows a plan view of a skid pallet which has the features of the present invention.
FIG. 21 shows a side view of the skid pallet from FIG. 20.
FIG. 22 shows a side view of the skid pallet of FIG. 20 turned through 90° relatively to the view shown in FIG. 21.
FIG. 23 shows a cross-section through a skid of the skid pallet from FIG. 20.
FIG. 24 shows a section through the central foot of the insert of a skid pallet and FIG. 25 shows an exploded view of an alternative arrangement.

FIG. 20 to 22 shows an alternative form of the invention with a skid pallet. Individual hollow section skids **39*a*, 39*b* and 39*c* parallel to one another are connected by way of the supporting legs 2 and the central supporting foot 26 to the top deck 1**.

FIG. 23 shows a view of a detail in section through a longitudinal frame bearer 16, 20, 17, 24 and through the hollow section of an external skid. The hollow section of the skid comprises a hollow section which is open towards the internal side of the pallet and consists of the booms 40 and 41 and the connecting web 42 connecting these, on the one hand and a complementary section 43 on the other hand. The section formed of the parts 40, 41 and 42 is connected with the supporting leg portions 33 which themselves are arranged on the associated section member bearer. The complementary section 43 again is secured on the supporting leg parts 44 which themselves are connected with the insert 9. The two skid parts which are complementary with one another are in each case made integrally with the corresponding section member bearer or the insert through the agency of the associated supporting leg portions 33 and 34 respectively.

The central skid which is connected with the supporting foot 26 secured to the center of the insert 9 and with the supporting feet arranged in the center of the longitudinal section member bearers 6 and 8, is attached in FIG. 24 as a closed hollow section 45, below, to the central foot 26 or to the two edge feet in the middle of the longitudinal section bearers 6 and 8 and connected with these supporting feet by a connecting method, preferably plastics welding, but adhesives or the like may also be used.

It is possible to weld the pallet on a welding machine without having to change the work fixing device. The insert is fixed in position and then first of all the two shorter frame members which are parallel to one another are applied, the welding arms are introduced into the joints and after they have been swung about the parts are welded to one another by pressing together. Then the same is carried out with the two longer frame members simultaneously.

As an alternative first of all a long frame member and a short frame member can be welded to the insert and then the two other frame members.

In another method for producing the pallets, first of all the four frame members are connected to form the general frame and then the insert is introduced from above. But in this case it is no longer possible to carry out mirror welding at least between frame and insert; it would then be necessary to change to the use of adhesives or individual welding.

Figure 25:
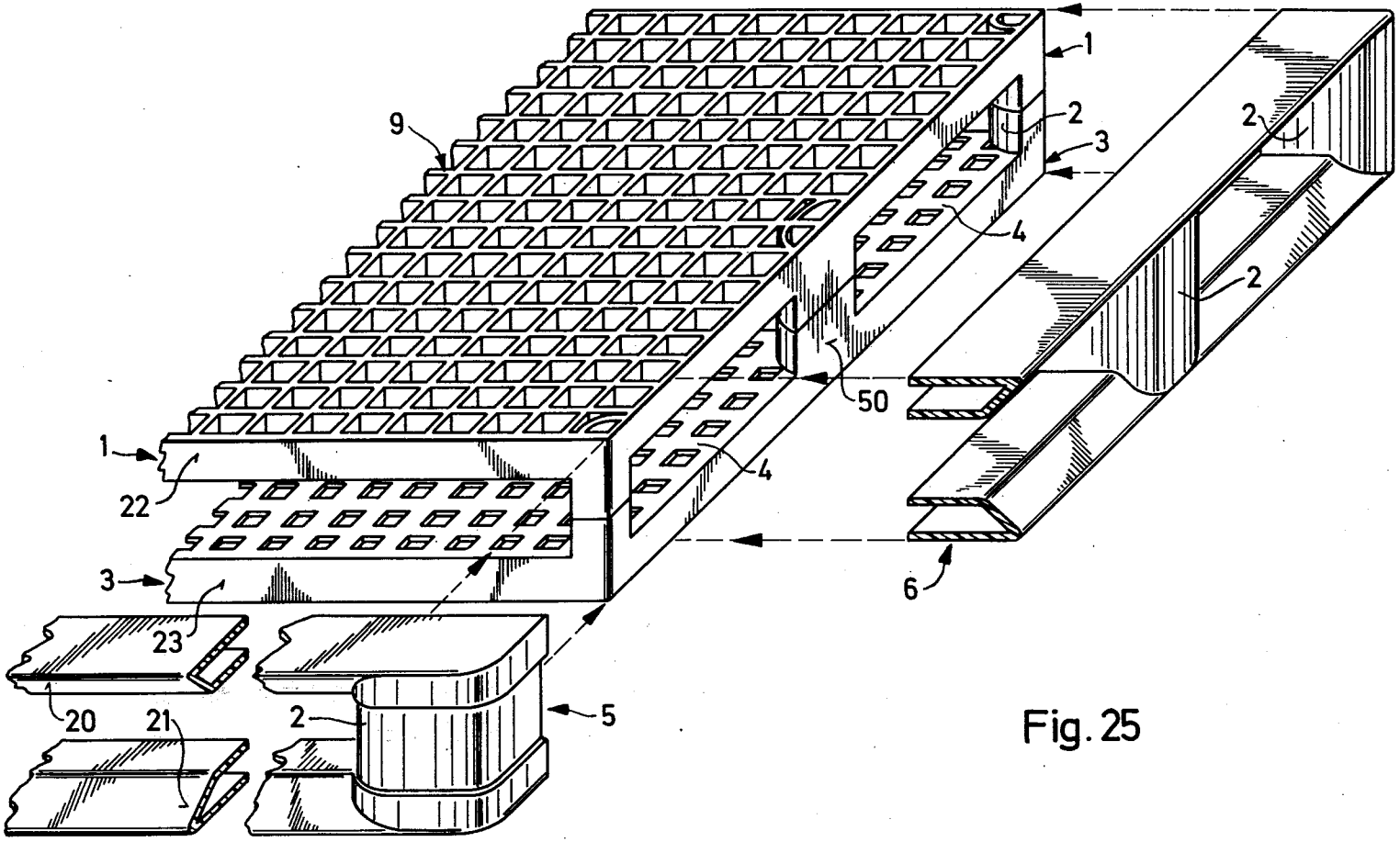

Although plastics material and metal pallets are different from one another basically, the invention leaves the possibility open of producing a flat pallet according to the invention by one of the recently developed light metal casting methods. FIG. 25 shows in an exploded view on the one hand the insert 9 and on the other hand two section members 5 and 6 of a frame of modified form. The view of the insert 9 shows that the insert is made up of mirror-image arrangements on the horizontal central plane. At the plane of division between the insert 9 and the members 5 and 6 the insert 9 comprises closed encircling edge regions which are interrupted only at the engagement apertures 4 for the fork lift truck arms. This means that not only the closed edges 22 and 23 but also in the region of the supporting legs 2 an end surface 50 for the internal region of the supporting legs is provided between the top deck 1 and the lower deck 3. This modified form differs from the double-deck pallet previously described only as regards the additional end surface 50.

We claim:

1. A pallet made of plastics materials and comprising:

A. a load-bearing rigid frame having two longer sides, two shorter sides, and four corners;

B. a rigid deck insert which is fitted into and attached to said rigid frame;

C. a central supporting leg which is attached to said rigid deck insert at the center thereof; and D. eight supporting legs which are attached to the four corners of said rigid frame and to the four sides thereof, midway between two of said corners, each of said eight supporting legs comprising:

1. a smoothly curved outer surface which is vertically disposed,
2. a horizontally disposed supporting rib which is disposed within and rigidly attached to said smoothly curved outer surface,
3. a plurality of vertically disposed supporting ribs which are disposed within and rigidly attached to said smoothly curved outer surface and to said horizontally disposed supporting rib, and
4. said smoothly curved outer surfaces and said vertically disposed supporting ribs attached to said rigid frame in a manner to provide a smooth connection therebetween, four of said eight supporting legs being disposed at said four corners and having said vertically disposed supporting ribs aligned with said two shorter sides, two of said supporting legs being disposed midway of said longer sides and having said vertically disposed supporting ribs aligned with said two shorter sides, and two of said supporting legs being disposed midway of said shorter sides and having said vertically disposed supporting ribs aligned with said two longer sides.

2. The pallet of claim 1 wherein said central supporting leg comprises:

A. a smoothly curved outer surface which is vertically disposed,

B. a central vertically disposed supporting rib which is disposed within and rigidly attached to said smoothly curved outer surface and is aligned with said two longer sides, C. a plurality of vertically disposed supporting ribs which are disposed within and rigidly attached to said smoothly curved outer surface and to said central vertically disposed supporting rib and are aligned with said shorter sides, said central supporting leg being disposed at the center of said deck insert in rigidly interconnecting and supporting relationship.

3. The pallet of claim 1 wherein said eight supporting legs and said central supporting leg are additionally attached at the lower ends thereof to three skids which are disposed in parallel.

4. The pallet of claim 2 wherein said eight supporting legs and said central supporting leg are attached to a lower rigid frame having four corners, two longer sides, and two shorter sides, similar to said load-bearing rigid frame, and wherein a rigid deck insert is fitted into and attached to said lower rigid frame and comprises vertical curved parts which complement and are attached to said smoothly curved outer surfaces of said eight supporting legs and said central supporting leg.

5. A double-deck pallet in which a top deck bears upon a lower deck by means of supporting legs which are spaced to provide a plurality of fork-lift engagement apertures therebetween, said top deck and said bottom deck each comprising:

A. a four-cornered and four-sided rigid frame which comprises:

1. two side frame bearers which are as long as the length of said pallet each comprising an upper boom, a lower boom, and an intermediate web, said intermediate web being rigidly attached along its sides to said upper boom and said lower boom along the side edges thereof to form one of said two side frame bearers as a hollow member open toward the center of said pallet and said intermediate web being a forklift guiding surface for said pallet along said apertures, and
2. two end frame bearers having a length equal to the width of said pallet minus twice the width of said upper boom, said intermediate web being rigidly attached along its sides to said upper boom and said lower boom along the side edges thereof to form one of said two end frame bearers as a hollow member open toward the center of said pallet and said intermediate web being a fork-lift guiding surface for said pallet along said apertures, said two side frame bearers and said two end frame bearers being perpendicularly and rigidly interconnected in endwise relationship to form said four-cornered and four-sided rigid frame;

B. a rigid deck insert, comprising upper and lower flat patterned surfaces which are horizontally disposed, said rigid deck insert fitting closely within and rigidly attached to said four-cornered and four-sided rigid frame to form one of said decks;

C. eight of said supporting legs, each comprising:

1. a smoothly curved outer surface which is vertically disposed,
2. a horizontally disposed supporting rib which is disposed within and rigidly attached to said smoothly curved outer surface,
3. a plurality of vertically disposed supporting ribs which are disposed within and rigidly attached to said smoothly curved outer surface and to said horizontally disposed supporting rib, and
4. said smoothly curved outer surface and said vertically disposed supporting ribs attached to said inner flat patterned surfaces, to said lower booms, and to said intermediate webs of said four frame bearers forming each said frame of said top and bottom decks, in a manner to provide a smooth connection therebetween, four of said supporting legs being corner legs of which each is disposed at a corner of said top deck and said bottom deck in interconnecting and supporting relationship and in which said vertically disposed supporting ribs are aligned with said end frame bearers, two of said legs being side-bearer legs, of which each is disposed midway of one of said side frame bearers and in which said vertically disposed supporting ribs are aligned with said end frame bearers, and two of said legs being end-bearer legs of which each is disposed midway of one of said end frame bearers and in which said vertically disposed supporting ribs are aligned with said side frame bearers; and D. one of said supporting legs which is disposed as a central supporting leg having:
1. a smoothly curved outer surface which is vertically disposed,
2. a central vertically disposed supporting rib which is disposed within and rigidly attached to said smoothly curved outer surface and is aligned with said side frame bearers, and
3. a plurality of vertically disposed supporting ribs which are disposed within and rigidly attached to said smoothly curved outer surface and to said central vertically disposed supporting rib and are aligned with said end frame bearers, said central supporting leg being disposed at the center of said deck inserts in rigidly interconnecting and supporting relationship.

6. The double-deck pallet of claim 5 wherein each said rigid deck insert further comprises a plurality of perpendicularly intersecting vertical webs which complement, coincide with, and are attached to:

A. said central vertically disposed supporting rib of said central supporting leg, and
B. said plurality of vertically disposed supporting ribs of said eight supporting legs.

7. The double-deck pallet of claim 6 wherein each said rigid deck insert further comprises vertical curved parts which are connected to said perpendicularly intersecting vertical webs and complement, coincide with, and are attached to said smoothly curved outer surface of said central supporting leg.

8. The double-deck pallet of claim 7 wherein each said rigid deck insert further comprises vertical curved parts which are connected to said perpendicularly intersecting vertical webs of each said rigid deck insert and complement, coincide with, and are attached to said smoothly curved outer surface of each of said eight supporting legs.

9. A pallet made of plastic materials and comprising:

A. a load-bearing rigid frame having four sides and four corners, said load-bearing rigid frame being constructed from a pair of individually molded side frame bearers and a pair of individually molded end frame bearers, each said side frame bearer and each said end frame bearer comprising a plurality of horizontally disposed cavities that extend inwardly from a smoothly curved outer frame surface and are open inwardly only;
B. a rigid deck insert which is fitted into and attached to said rigid frame, comprising a plurality of vertically disposed cavities that are arranged in a grid pattern and are open at both top and bottom ends, said vertically disposed cavities mating along side edges thereof with end edges of said horizontally disposed cavities of said pair of side frame bearers and said pair of end frame bearers;
C. a central supporting leg which is attached to said rigid deck insert at the center thereof, comprising a smoothly curved outer leg surface which is vertically disposed and a plurality of vertically disposed cavities that;
1. are arranged within said outer leg surface in said grid pattern,
2. are open at both top and bottom ends, and
3. are spaced to provide mating along end edges thereof with end edges of said vertically disposed cavities of said rigid deck insert; and
D. eight supporting legs, four of which are attached to said four corners of said rigid frame and four of which are attached to said four sides thereof, each of said eight supporting legs comprising:
1. a smoothly curved outer surface which is vertically disposed, and
2. a plurality of vertically disposed cavities that:
a. are arranged within said smoothly curved outer surface in said grid pattern,
b. are open at both top and bottom ends thereof, and
c. are spaced to provide mating along end edges thereof with end edges of said vertically disposed cavities of said rigid deck insert and with side edges of said horizontally disposed cavities of said side frame bearers and said end frame bearers, each said mating being in a manner to provide a smooth connection therebetween.

* * * * *

UNITED STATES PATENT AND TRADEMARK OFFICE

CERTIFICATE OF CORRECTION

PATENT NO. : 4,013,021

DATED : March 22, 1977

INVENTOR(S) : Steinlein & Schoeller

It is certified that error appears in the above-identified patent and that said Letters Patent are hereby corrected as shown below:

Claim 3, line 1, delete "1" and insert --2-- in lieu thereof after "claim".

Signed and Sealed this

*twenty-third* Day of *August 1977*

[SEAL]

*Attest:*

RUTH C. MASON
*Attesting Officer*

C. MARSHALL DANN
*Commissioner of Patents and Trademarks*